United States Patent [19]

Ward

[11] Patent Number: 4,799,510

[45] Date of Patent: Jan. 24, 1989

[54] VALVE FOR USE IN CONTROLLING THE FUNCTIONS OF MINE ROOF SUPPORTS

[75] Inventor: Richard Ward, Manchester, England

[73] Assignee: Gullick Dobson Limited, Wigan, England

[21] Appl. No.: 31,956

[22] Filed: Mar. 30, 1987

[30] Foreign Application Priority Data

Apr. 3, 1986 [GB] United Kingdom ..... 8608176

[51] Int. Cl.[4] ..... F15B 13/06

[52] U.S. Cl. ..... 137/596.15; 137/596.18; 137/627.5; 137/635

[58] Field of Search ..... 137/596.15, 596.18, 137/627.5, 635, 637.1; 405/302

[56] References Cited

U.S. PATENT DOCUMENTS

| | | | |
|---|---|---|---|
| 3,289,701 | 12/1966 | Booth et al. | 137/637.1 |
| 3,646,969 | 3/1972 | Stampfli | 137/627.5 |
| 4,006,753 | 2/1977 | Ingram, Jr. et al. | 137/607 |
| 4,466,456 | 8/1984 | Hansen | 137/596 |

FOREIGN PATENT DOCUMENTS

| | | | |
|---|---|---|---|
| 784820 | 10/1957 | United Kingdom . | |
| 897604 | 5/1962 | United Kingdom . | |
| 1529994 | 10/1978 | United Kingdom . | |
| 2095425 | 9/1982 | United Kingdom . | |
| 2142074 | 6/1983 | United Kingdom . | |
| 2153971 | 8/1985 | United Kingdom | 137/596.18 |

*Primary Examiner*—Gerald A. Michalsky

*Attorney, Agent, or Firm*—Armstrong, Nikaido, Marmelstein & Kubovcik

[57] ABSTRACT

A valve assembly is provided for use in controlling a plurality of fluid operated functions. The assembly comprises a plurality of valve members 14, each movable independently to carry out a fluid flow control function for example, a function of a hydraulic mine roof support. There are means 39 for supplying hydraulic fluid to all the valve members 14 thus tending to move all the valve members, but there is also an interposer device 18 positionable in the path of at least one of the valve members to prevent the said one of the valve members from carrying out its fluid control function, thus enabling the valve members to be selectively operable.

16 Claims, 19 Drawing Sheets

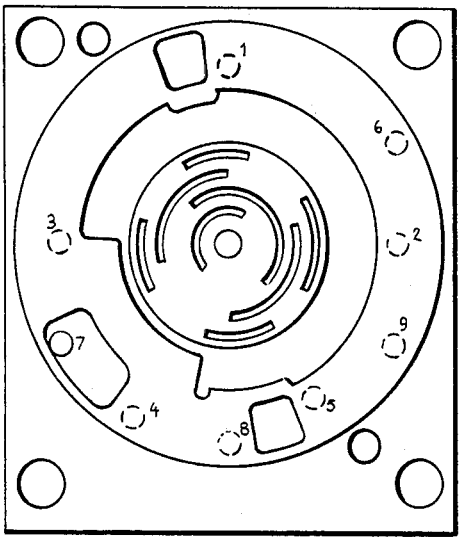
FIG.25.
FIG.26.
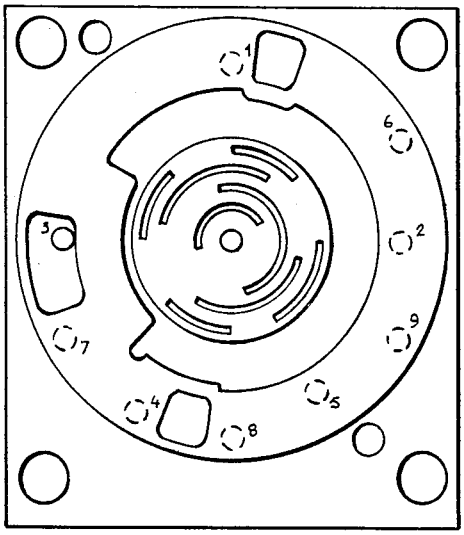

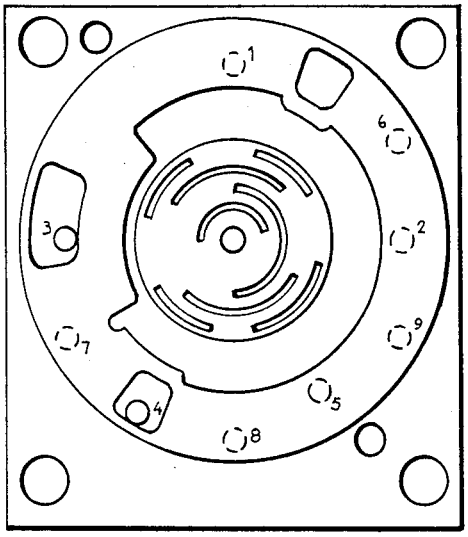
FIG.27.
FIG.28.
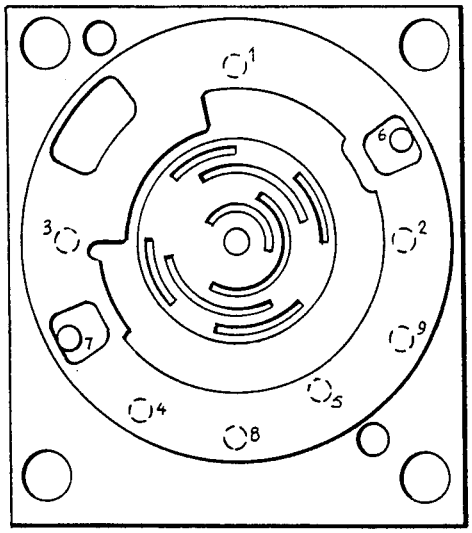

VALVE FOR USE IN CONTROLLING THE FUNCTIONS OF MINE ROOF SUPPORTS

The invention relates to valves and particularly, though not exclusively, to valves for use in controlling the functions of mine roof supports.

The operation of a modern hydraulic mine roof support involves the carrying out of a number of different functions such as the extension of a ram to push a coal conveyor away from a support into a newly cut part of a coal seam, the retraction of hydraulic legs of the support to free the support from the mine roof, the retraction of the said ram to draw the support up to the newly positioned conveyor, and the extension of the legs to reset the support to the mine roof.

Various types of valve are known for controlling the flow of hydraulic fluid required for these functions and some known valves are described in U.K. Patent Specification No. 2095425 and U.K. Patent Application No. 8316838.

Our Patent Specification No. 2153971 describes an improved valve suitable for controlling the functions of a hydraulic mine roof support, the valve comprising a valve body, a plurality of valve members each movable independently to carry out a fluid flow control function, a plurality of valve actuating members movable in a direction tending to actuate the valve members, and and an interposer device movable to prevent at least one of the valve actuating members from actuating its associated valve, thus enabling the valves to be selectively operable.

The valve actuating members comprise fluid operated rams, the interposer disc being positioned between the rams and the valve members.

We have now developed an even more versatile, but more compact, valve, and in particular we have discovered that it is possible to eliminate the separately movable valve actuating rams.

Accordingly the invention provides a valve assembly for use in controlling a plurality of fluid operated functions, the valve assembly comprising a plurality of valve members each movable independently to carry out a fluid flow control function, means for supplying hydraulic fluid to all the valve members thus tending to move all the valve members, and an interposer device positionable in the path of at least one of the valve members to prevent the said one of the valve members from carrying out its fluid flow control function, thus enabling the valve members to be selectively operable.

Preferably each valve member moves in an associated valve chamber, each valve chamber having an inlet, an outlet and a service port, each valve member normally being positioned to close the associated inlet and connect the service port to the associated outlet, each valve member being movable along a path from the normal position to first seal the associated outlet and then open the associated inlet to connect the associated inlet to the associated service port.

Conveniently all the inlets may be connected to the same source of fluid pressure. Similarly all the outlets may be conveniently connected to a common return line.

Preferably the valve assembly includes a valve body comprising a body portion housing the valve members, and a cap portion, the cap portion having at least one space to receive an end of each valve member when the valve member moves, the interposer device comprising a plate-like member positioned between the body portion and the cap to prevent the end of at least one valve member from moving into the said space.

Preferably the cap member has a plurality of spaces, each in the form of a socket to receive an end of one of the valve members.

Preferably the interposer device comprises a plate rotatable about an axis, the plate having a plurality of apertures therein, spaced apart circumferentially around the axis.

The apertures may be of different sizes.

Preferably the valve members and valve chambers are also spaced apart circumferentially around the said axis.

The apertures may be positioned with respect to the valve chambers and valve members such that in at least one position of the interposer device, only one valve member is movable to carry out a fluid flow control function, in at least one other position of the interposer device, two valve members are movable simultaneously to carry out fluid flow control functions, and in at least one other position of the interposer device, three valve members are movable simultaneously to carry out fluid flow control functions.

The valve members and valve chambers need not all lie on the same pitch circle.

Preferably the valve body incorporates a relay valve for use in supplying fluid pressure simultaneously to all the valve members.

Electrical means may be provided for moving the interposer device.

Preferably manual means are also provided for moving the interposer device.

Means may be provided to lock the manual means when the electrical means is in operation.

The valve members may co-operate with valve seats which are movable with respect to the valve members and the valve chambers.

For example a valve member may be arranged to move into contact with a first valve seat to close a fluid flow path and then move further to engage and move another valve seat to open another fluid flow path, the first valve seat moving sealingly with the valve member during said further movement.

By way of example, a specific embodiment of the invention will now be described, with reference to the accompanying drawings, in which:

FIGS. 15 to 30 are diagrams illustrating the various positions of the interposer device.

Figure 1:
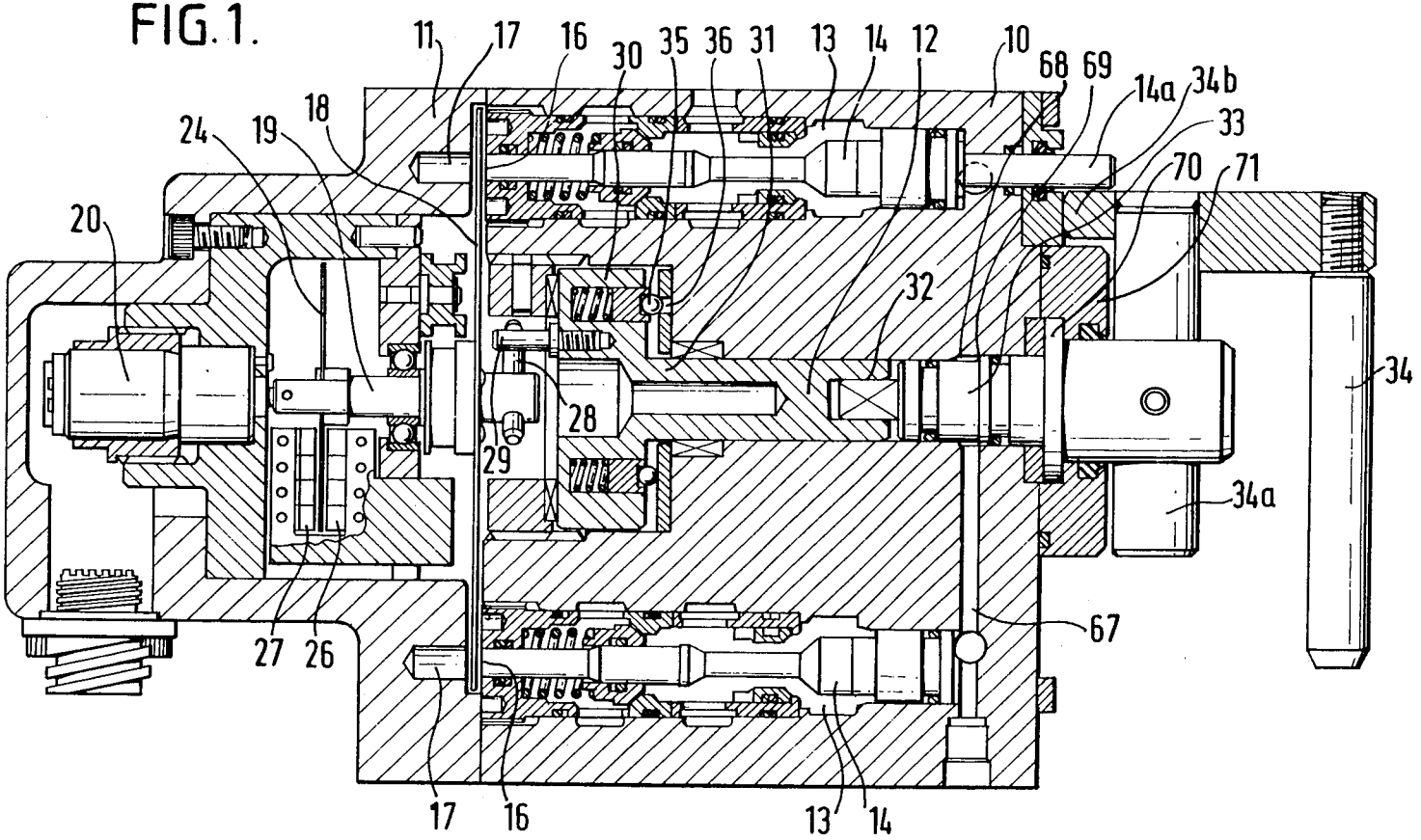
FIG. 1 is a cross section through an embodiment of valve according to the invention.
Figure 2:
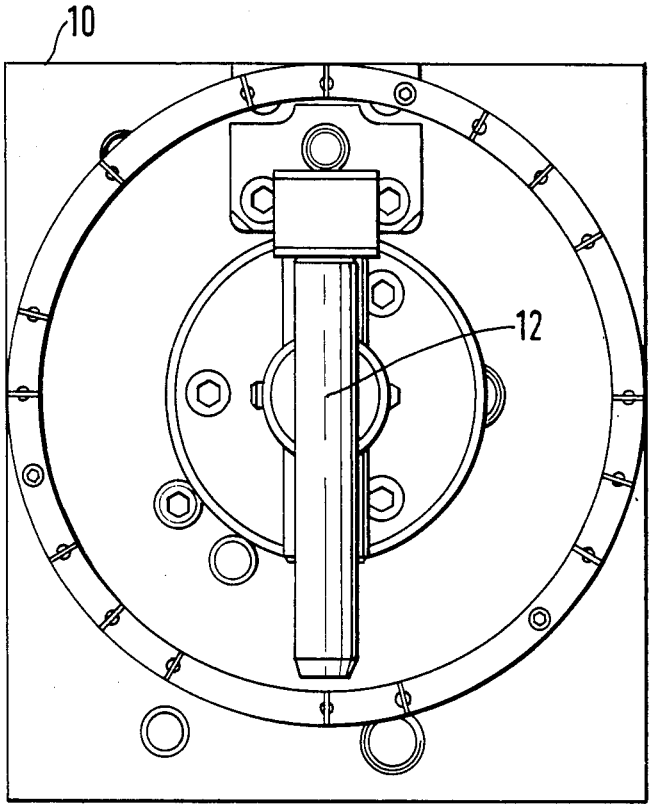
FIG. 2 is an end view of the valve shown in FIG. 1.

The valve shown in FIGS. 1 and 2 comprises a valve body 10 fitted with a cap 11. The valve body has a longitudinal axis 12 and circumferentially spaced apart around this axis, within the valve body, are nine valve chambers each containing a valve spindle. Two chambers 13 and associated spindles 14 are visible in FIG. 1. All the valve chambers 13 are visible in FIG. 4, and it will also be seen that there is a relay valve chamber 15.

The valve spindles 14 are longitudinally movable from the position shown in FIG. 1 to carry out various functions, as will be described in more detail below. The ends 16 of the valve spindles are flush with the end of the valve body 10. The cap 11 contains nine sockets 17 arranged in register with the ends 16 of the valve spindles 14. Between the ends 16 and the sockets 17 there is arranged an interposer disc 18 mounted for rotation about the axis 12. The disc is mounted on a shaft 19 which can be driven by an electric motor 20 mounted in the cap 11.

Figure 16:
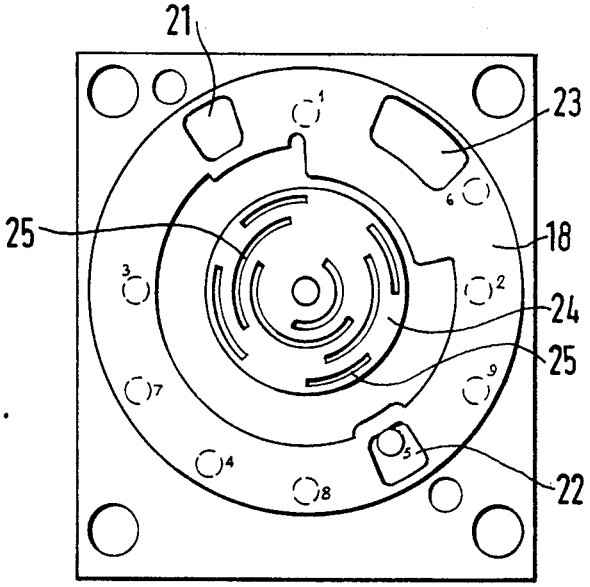
Figure 17:
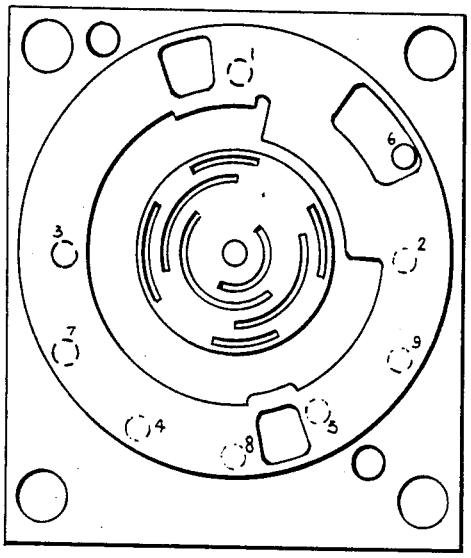
Figure 18:
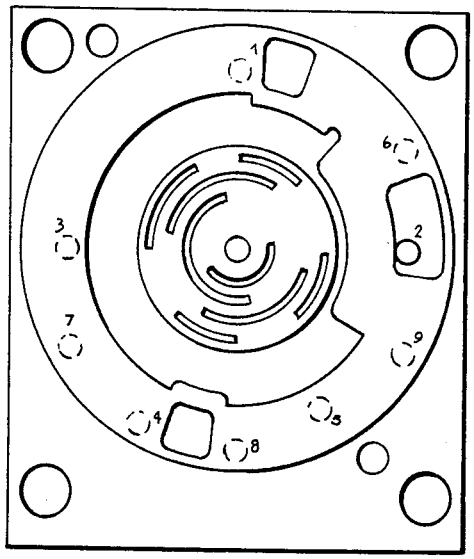
Figure 19:
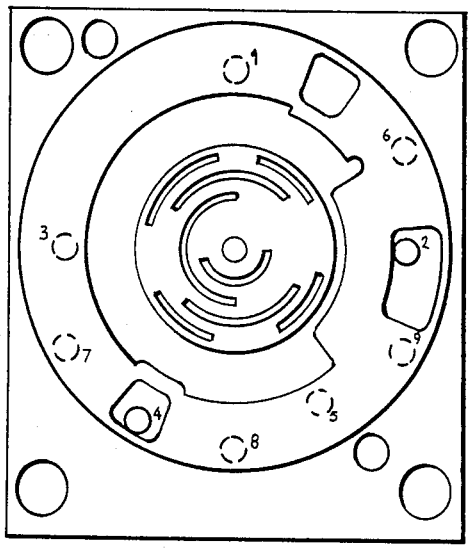
Figure 20:
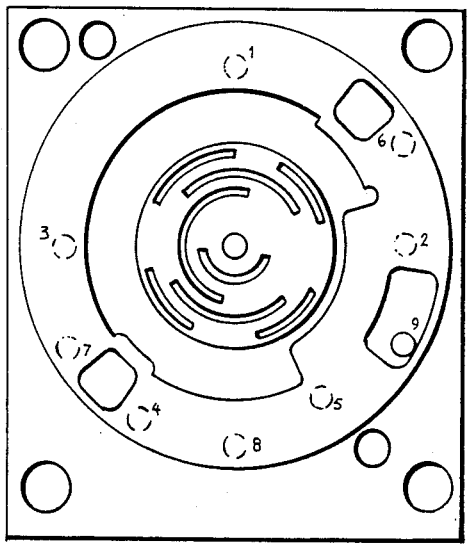
Figure 21:
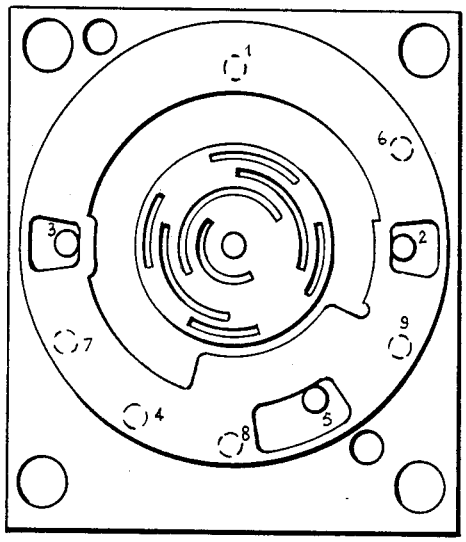
Figure 22:
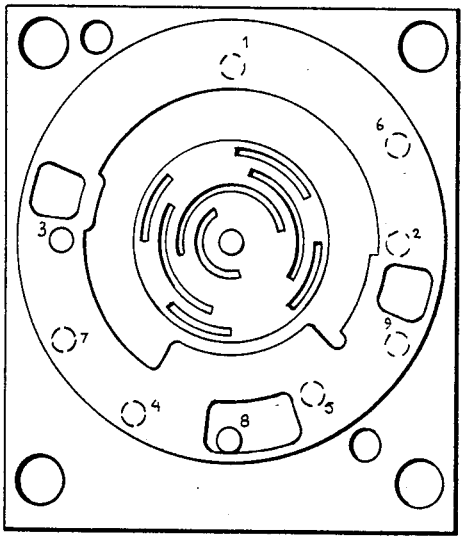
Figure 23:
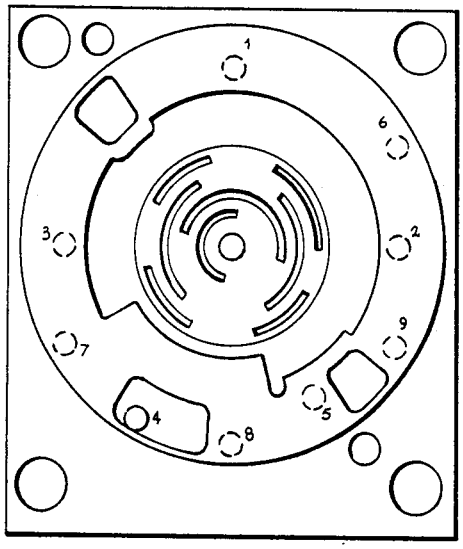
Figure 24:
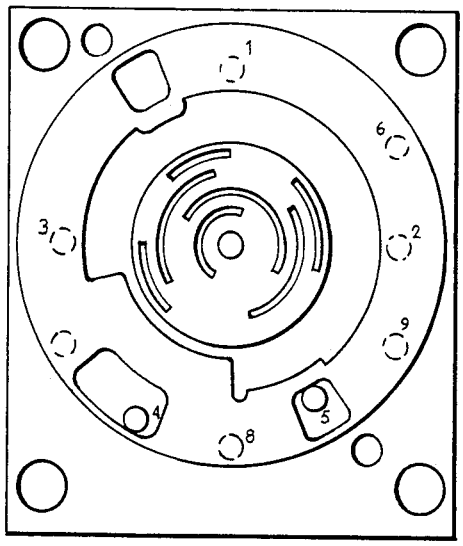
Figure 29:
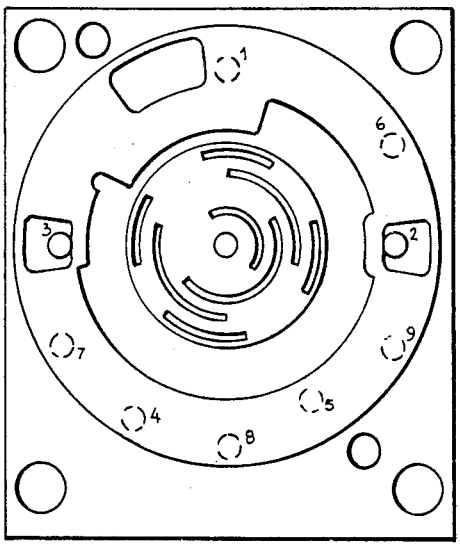
Figure 30:
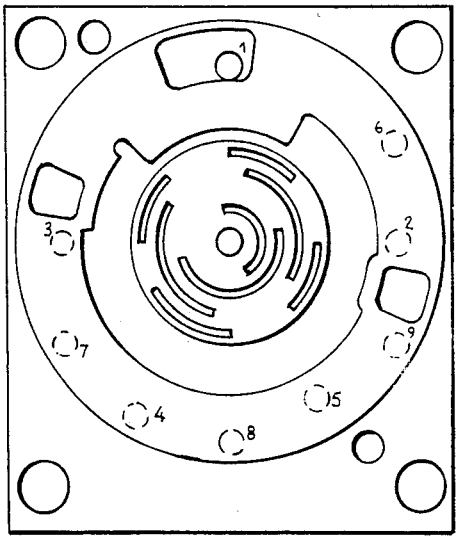

As can be seen from FIG. 16, the disc 18 has three holes therein, 21, 22 and 23. When fluid pressure is applied as described below, tending to move the valve spindles 14, only a valve spindle which is in register with one of the holes in the interposer disc is able to move to carry out its fluid control function. Movement of the other valve spindles is arrested when the ends 16 of the valve spindles come into abutment with the disc 18. The end 16 of any given spindle cannot move into the associated socket 17 unless the interposer disc 18 has been rotated to a position which puts one of its holes in register with the relevant socket 17.

The position of the interposer disc 18 is controlled by a further disc 24 also mounted on the shaft 19. As can be seen from FIG. 16, this disc 24 has a plurality of arcuate slots 25 therein. The disc 24 extends between an array of light emitting diodes 26 and an array of photo transistors 27. Each transistor is in register with one of the light emitting diodes. The arrangement of the diodes, transistors, and slots 25 is such that, for any given position of the disc 24, the photo transistors generate a code which is unique to that position.

In use the valve is controlled by a control circuit (not shown) which generates a binary code corresponding to the code which would be produced by the disc 24 when the interposer disc 18 is at a position corresponding to the desired function which is to be carried out by one of the valve spindles. The binary code signal may be supplied from manually operated control means, or from a remote point, such as a computer positioned at the end of a mine face.

The motor 20 is then switched on and the light emitting diodes are energised. The motor rotates the interposer disc 18 until it reaches the angular position which causes the light emitting diodes and photo transistors to generate a code which corresponds to the preselected binary code. The motor is then switched off and dynamically braked.

Under certain circumstances it may be necessary or desirable to rotate the disc 18 manually. To facilitate this the shaft 18 is provided with a radially extending pin 28. Adjacent this pin there is an axially extending pin 29 mounted on the head 30 of a shaft 31. Keyed to the shaft 31 at 32 there is a further shaft 33 which projects from the end of the valve body 10 and is rotatable by means of a handle 34. To facilitate the rotation of the handle 34 between discrete positions, each corresponding to an appropriate position of the interposer disc 18, spring-loaded balls 35 are provided, one of which clicks into a socket 36 at each desired position.

The various possible positions of the valve spindles 14 will now be described, with reference to one typical valve spindle, as shown in FIGS. 9 to 13.

The valve spindle 14 has a cylindrical portion 37 which slides sealingly within a bore 38 of the valve chamber. The free end of the portion 37 is exposed to the pressure is a pilot pressure port 39. The valve spindle also has a tapered valve surface 40 and a shoulder 41. Between the end 16 and the shoulder 41 a portion 42 of the valve spindle slides sealingly within a poppet 43 which is normally urged by a spring 44 against a valve seat 45.

The space between the end 16 and the valve body 10 is sealed by a member 46. The chamber 47 defined thereby communicates with a supply port 48. The valve chamber has two further portions 49 and 50 between which there is a further tapered valve seat 51. The portion 50 communicates with a return port 52 and the portion 49 communicates with a service port 53.

Figure 9:
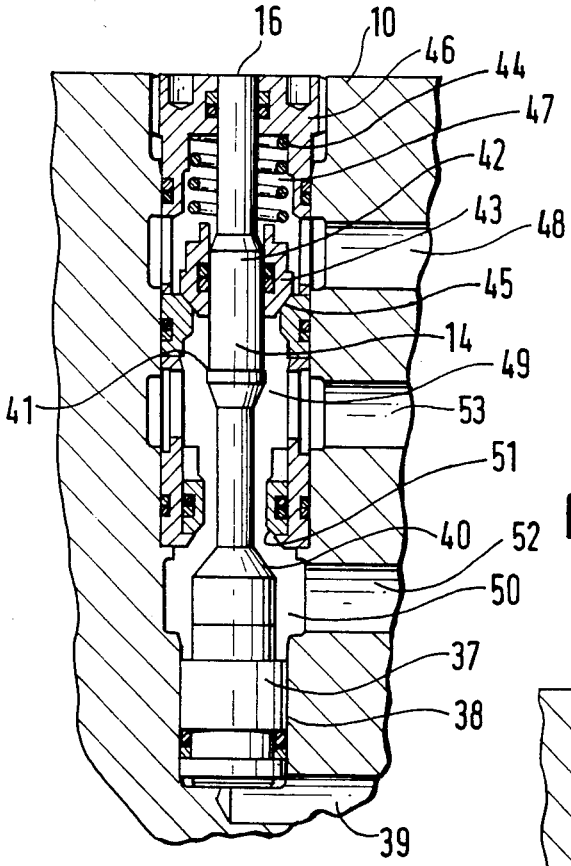
FIGS. 9 to 13 are cross sectional views through one of the valve chambers, illustrating various stages of the movement of a valve spindle within the valve chamber.
Figure 10:
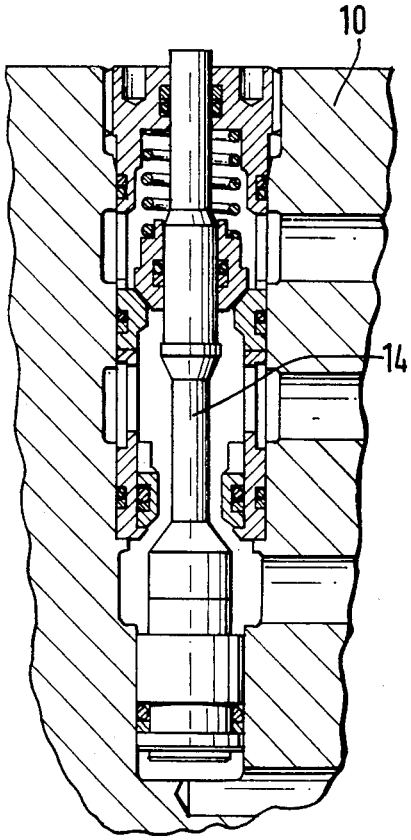

In the normal position shown in FIG. 9, the supply port 48 is sealed off by the engagement of the poppet 43 with the valve seat 45 and the service port 53 is connected to the return port 52 so that the function that is controlled by this particular valve spindle is inoperative, although return flow can still take place from the service port 53 to the return port 52. The function may be any one of a number of functions. Where the valve is used with a hydraulic mine roof support for example, the function may be to raise the hydraulic legs of the support.

When the valve is actuated, pressurised hydraulic fluid is applied to all the pilot ports 39, in the manner described below. This tends to move the valve spindle upwardly as viewed in FIG. 9. Any valve spindles which are not in register with holes in the interposer disc can move only to the position shown in FIG. 10, in which the end 16 of the valve spindle will abut the interposer disc. The small amount of movement of the valve spindle, of the order of 3 mm, is insufficient to cause any change in the relationship between the function of the ports 48, 52 and 53 and the valve spindle does not carry out any fluid flow control function.

Figure 11:
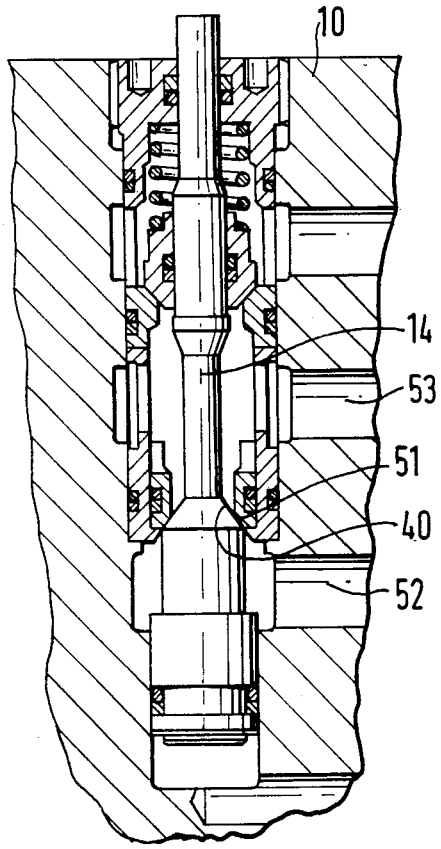
Figure 12:
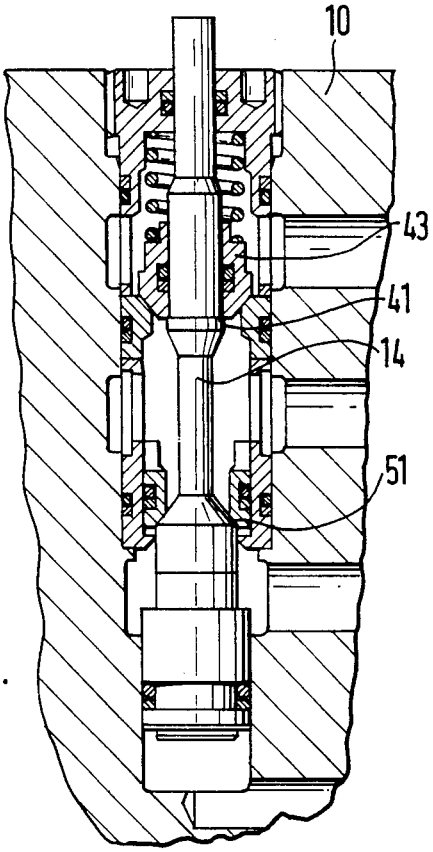
Figure 13:
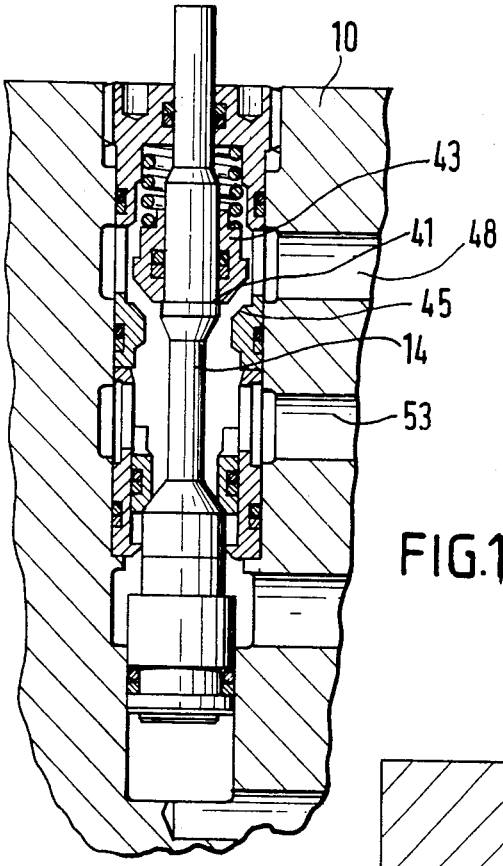

Those valve spindles which are in register with holes in the interposer disc move progressively through the positions shown in FIGS. 11 to 13.

The tapered surface 40 first comes into contact with the valve seating 51 as shown in FIG. 11, sealing off the service port 53 from the return port 52. Further movement to the position shown in FIG. 12 brings the shoulder 41 into engagement with the poppet 43. During this movement the tapered surface 40 remains in contact with the valve seat 51, the valve seat 51 being free to slide sealingly within the valve body to accommodate this movement.

Finally, as viewed in FIG. 13, the shoulder 41 lifts the poppet 43 off the valve seating 45 so that the service port 53 is in communication with the supply port 48 and hydraulic fluid is able to flow out of the service port 53 to carry out the associated fluid flow control function.

All the pilot ports 39 are interconnected so it is not necessary to supply fluid selectively to the valve spindles. Similarly all the supply ports 48 are interconnected and all the return ports 52 are interconnected. It is only the service ports 53 which require separate fluid connections to take the fluid to actuate whatever function is being controlled by the associated valve spindle. FIGS. 3 to 8 show how drillings are provided in the valve body to bring about these interconnections.

Figure 7:
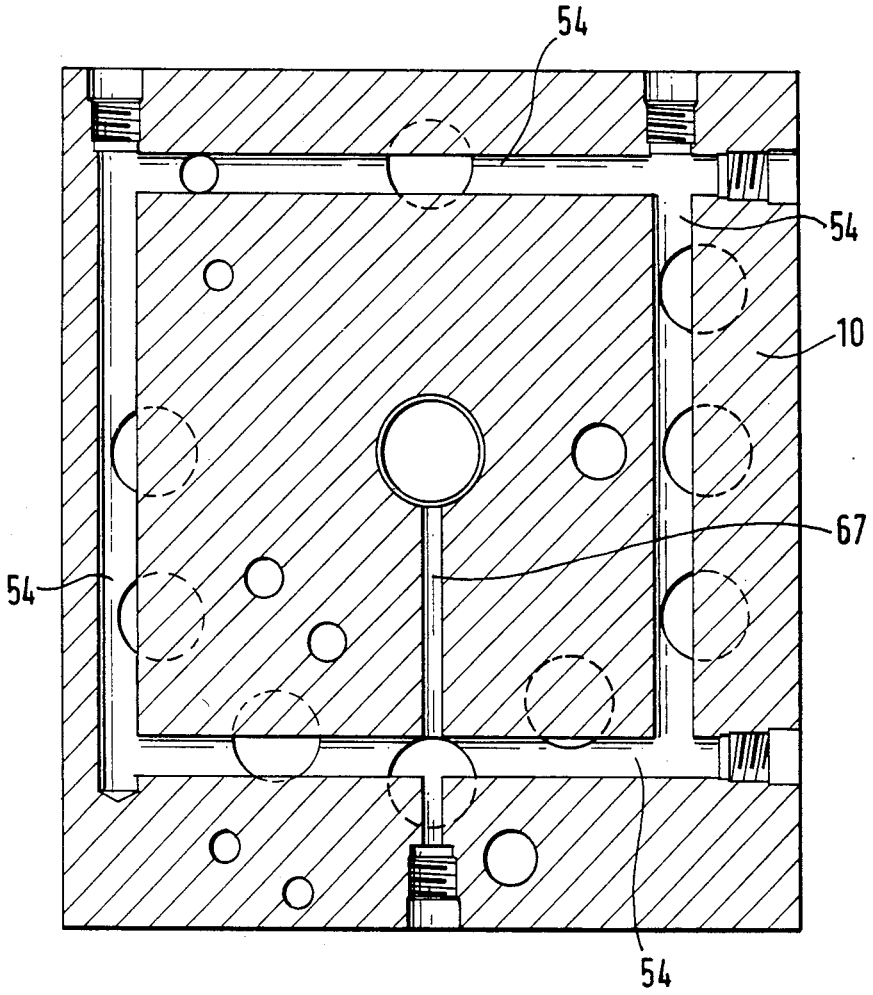

FIG. 7 shows how four drillings 54 communicate with each of the valve chambers. A comparison of FIGS. 3 and 9 will show that the drillings 54 are positioned such that they constitute the pilot ports 39.

Figure 3:
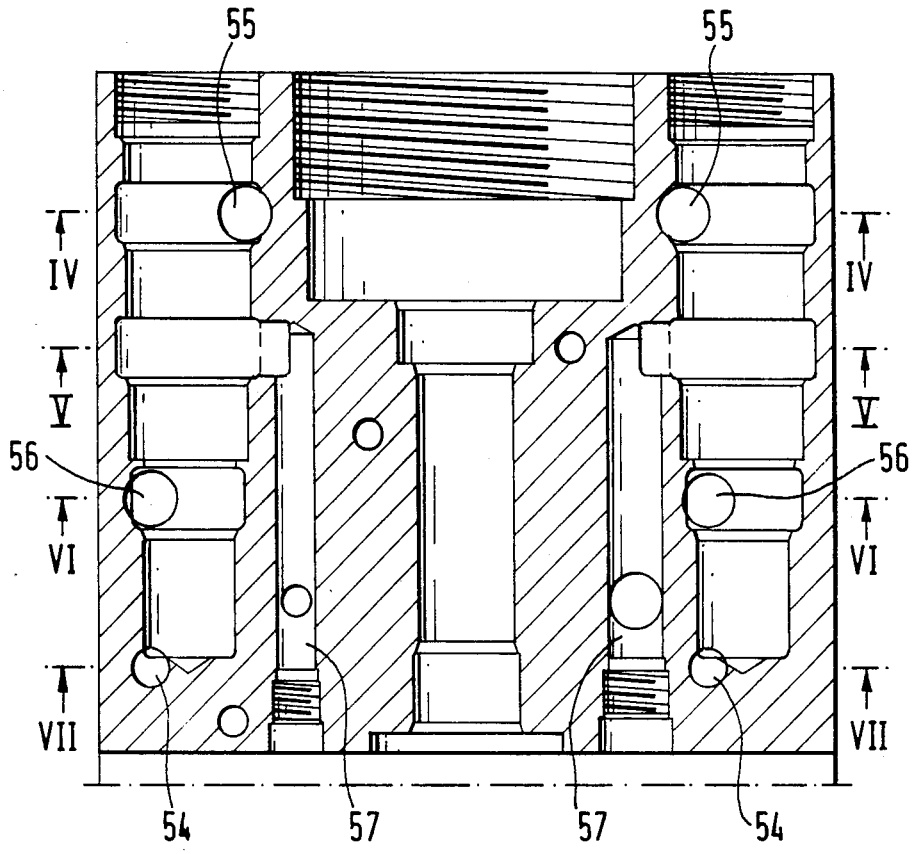
FIG. 3 is a cross sectional view of the valve body, taken along the longitudinal axis of the valve body.
Figure 4:
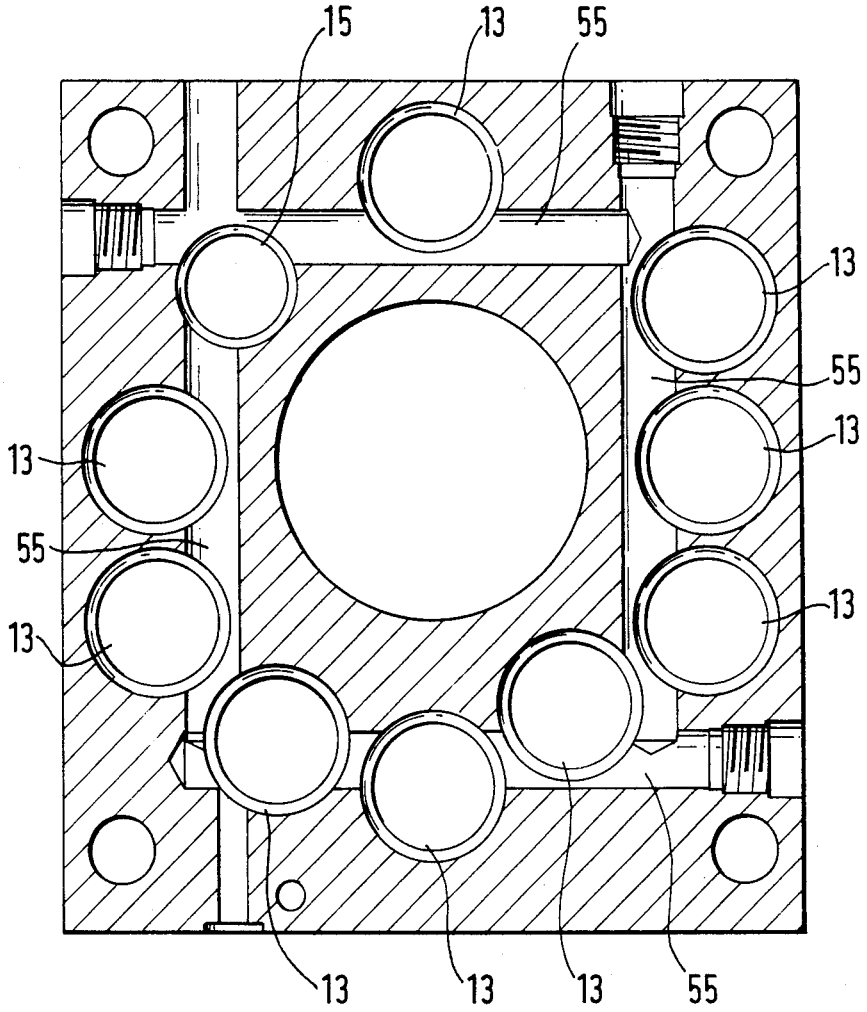
FIGS. 4 to 7 are cross sectional views taken on lines IV—IV, V—V, VI—VI, and VII—VII, of FIG. 3 respectively.
Figure 5:
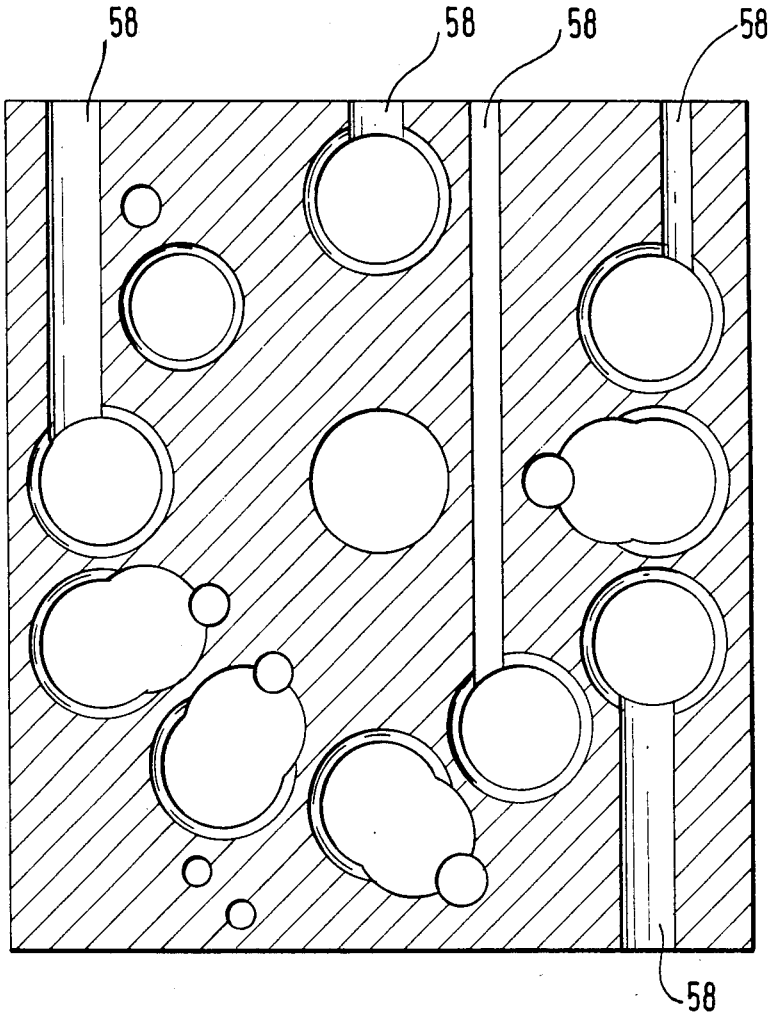

It can be seen from FIGS. 3 and 4 how four drillings 55 interconnect the supply ports 48.

Figure 6:
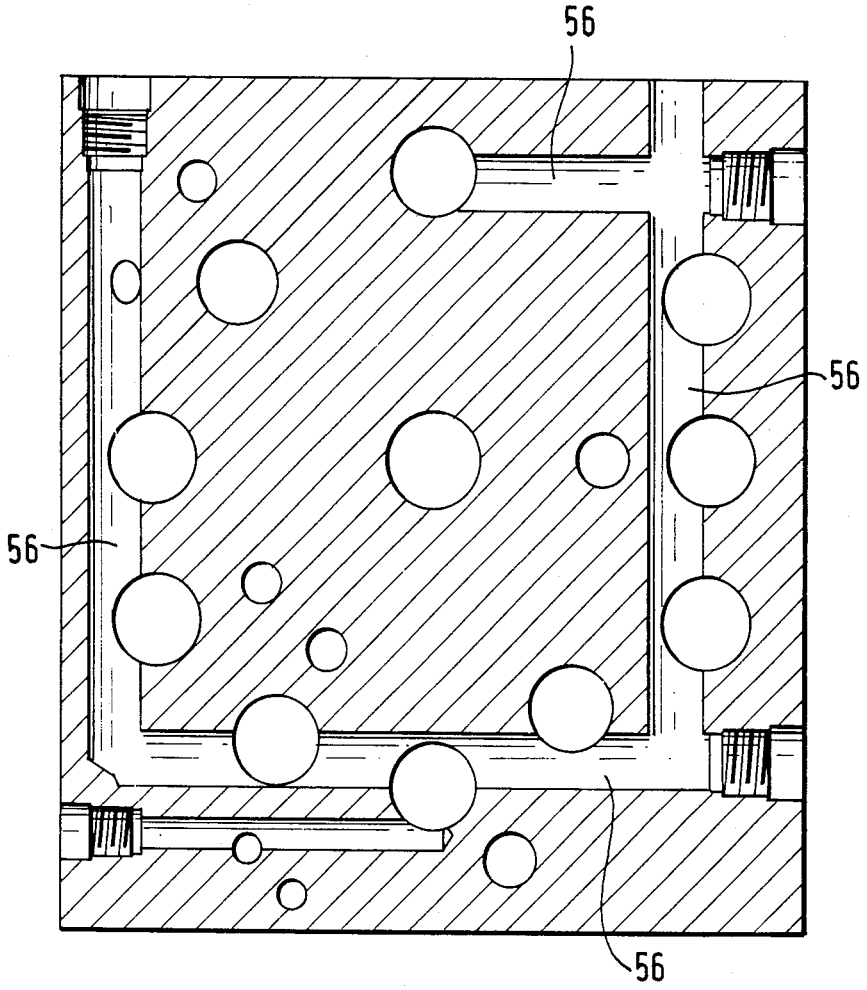

Similarly it can be seen from FIGS. 3 and 6 how four drillings 56 interconnect the return ports 52.

As previously mentioned, each of the service ports 53 requires a separate connection. Some of these extend parallel to the longitudinal axis of the valve, for example as shown at 57 in FIG. 3, and some extend at right angles to the longitudinal axis of the valve, for example as shown at 58 in FIG. 5.

As already mentioned, the valve chamber 15 shown in FIG. 4 accommodates a relay valve. The relay valve will now be described in more detail with reference to FIG. 14.

Figure 8:
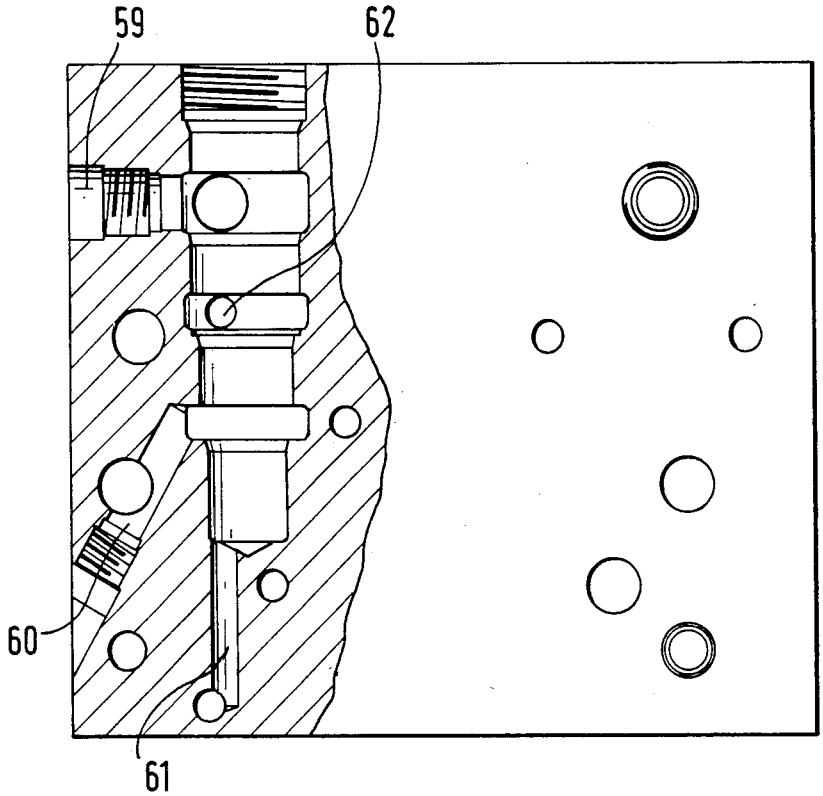
FIG. 8 is a further cross sectional view of the valve body taken on the longitudinal axis of the valve body but through the valve chamber of a relay valve.
Figure 14:
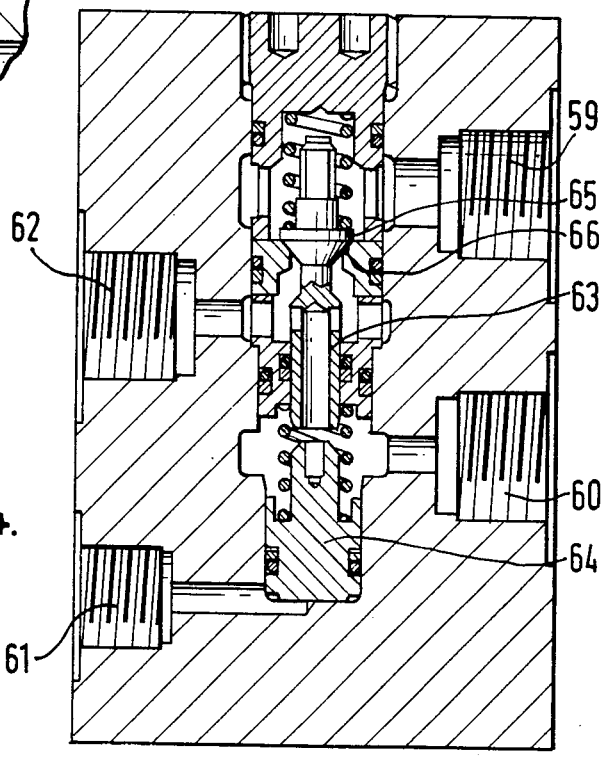
FIG. 14 is a cross sectional view through the pilot valve.

Part of the valve body is illustrated diagrammatically in FIG. 14. The valve body defines, again as shown diagrammatically, a feed port 59, a return port 60, a pilot port 61, and a service port 62. In practice the pilot port 61 is connected to a single source of pilot pressure via an external electrically operated valve (not shown). The return port 60 is connected to a hydraulic return line, the feed port 59 is connected to a source of high pressure hydraulic fluid, and the service port 62 is connected to all the pilot ports 39 of the other valve chambers. The positions of the actual ports are illustrated in FIG. 8.

When the valve is not operating, the service port 62 is connected to the return port 60 via a hollow valve spindle 63. When the main valve is actuated, and the motor 20 is driven and then stopped, the electrically operated valve is opened to apply pressure to the port 61 and this moves a piston 64. This piston first seals the hollow valve spindle 63, cutting off the service port 62 from the return port 60, and the piston then moves the hollow valve spindle 63 to lift a valve portion 65 off a valve seat 66 and put the feed port 59 into communication with the service port 62. Since the service port 62 is connected to all the pilot ports 39, the pilot ports 39 are all simultaneously pressurised and all the valve spindles 14 attempt to move, the operative selection of the valve spindles 14 being controlled by the interposer disc.

When the function controlled by the selected valve spindle has been completed, the external control circuit closes the electrically operated valve, cutting off the pressure to port 61. Hence the relay valve closes, cutting off pilot pressure to the valve spindles. They therefore return to the position shown in FIG. 9 under the influence of the pressure applied to the ports 48. In effect the relay valve acts as a flow amplification valve, allowing the valve spindles to return more quickly than if pilot pressure was applied directly from the electrically operated valve.

It will be seen from FIG. 7 that there is a passage 67 leading from one of the pilot drillings 54 towards the centre of the valve body 10. A study of FIG. 1 will show that this passage 67 supplies pressure to a small chamber 68 surrounding the shaft 33. This pressure acts on a shoulder 69 and urges the shaft 68 to the right as in FIG. 1. This urges a friction disc 70 against a collar 71 and this prevents the handle 34 from being rotated while pilot pressure is being applied to the valve chambers.

Turning now to FIGS. 15 to 30. The various positions of the interposer disc are shown in detail. For identification purposes the nine valves have been numbered 1 to 9.

Figure 15:
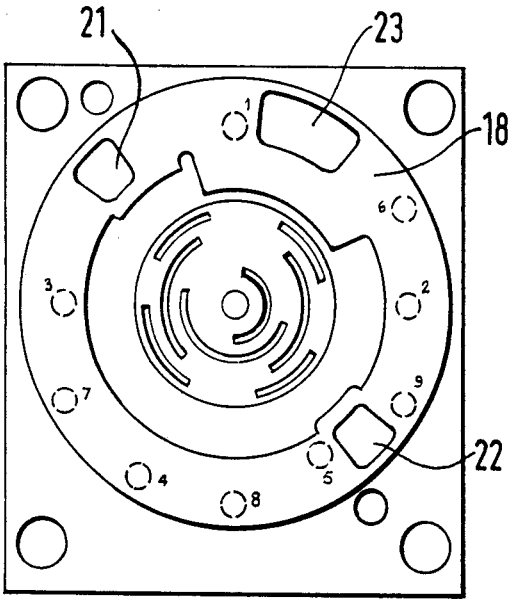

FIG. 15 illustrates a neutral position of the disc 18 in which none of the valve spindles identified by the numbers 1 to 9 are in registration with any of the holes 21, 22 or 23.

In FIG. 16 on the other hand, the valve spindle designated by the number 5 is in registration with hole 22 and so this valve spindle will operate when pilot pressure is applied. The arrangement of valve spindles and interposer disc holes shown is extremely versatile. It enables each of the nine valves to be operated independently. It also enables certain groups of two valves to be operated simultaneously, and also enables one group of three valves to be operated simultaneously. The table below shows which valve spindles are operated in each of the Figures.

| Figure No. | Valve spindles operated |
|---|---|
| 16 | 5 |
| 17 | 6 |
| 18 | 2 |
| 19 | 2 and 4 |
| 20 | 9 |
| 21 | 2, 3 and 5 |
| 22 | 8 |
| 23 | 4 |
| 24 | 4 and 5 |
| 25 | 7 |
| 26 | 3 |
| 27 | 3 and 4 |
| 28 | 6 and 7 |
| 29 | 2 and 3 |
| 30 | 1 |

It will be seen from FIG. 1 that one of the valve spindles has an extension **14*a* which projects from the valve body in the inoperative condition. In this embodiment this is the valve spindle which controls the pushing of the conveyor. It is usually necessary for several supports to push the conveyor simultaneously and so it is desirable to be able to manually lock on this function. The handle 34 has a cross member 34*a* which can be slid radially with respect to the shaft 33. Once the valve spindle has moved to its operative position in which the end of exterior 14*a* will be flush with the valve body the handle 34 and cross-member 34*a* can be moved radially outwardly until a lug 34*b* abuts the extension 14*a*** manually locking the valve spindle in its operative condition.

The invention is not restricted to the details of the foregoing embodiment.

I claim:

1. A valve for use in controlling a plurality of fluid operated functions, said valve comprising:

a plurality of valve means each including a valve member, valve seat means and valve port means for carrying out a fluid control function, each said valve means being movable independently along a respective first path from an inoperative position to an operative position by fluid pressure;

fluid supply means for supplying fluid simultaneously to all of said valve means;

interposer means for permitting at least one said valve means to move along said first path from said inoperative position to said operative position in response to a supply of fluid from said fluid supply means while at the same time preventing the remaining valve means from moving to said operative position, said interposer means being movable along a second path which intersects each of said first paths of said valve means; and valve member receiving space for receiving at least one of said valve members upon movement of said valve members along said first path and through said second path, said valve member receiving space being disposed on one side of said second path, each said valve member in said inoperative position being disposed on the other side of said second path to said valve member receiving space, thereby enabling said valve means to be selectively operable.

2. A valve assembly as claimed in claim 1, in which each valve members moves in an associated valve chamber, each valve chamber having an inlet, an outlet and a service port, each valve member normally being positioned to close the associated inlet and connect the service port to the associated outlet, each valve member being movable along a path from the normal position to first seal the associated outlet and then open the associated inlet to connect the associated inlet to the associated service port.

3. A valve assembly as claimed in claim 2, in which all the inlets are connected to the same source for fluid pressure.

4. A valve assembly as claimed in claim 2, in which all the outlets are connected to a common return line.

5. A valve assembly as claimed in claim 2, in which the valve members cooperate with valve seats which are movable with respect to the valve members and the valve chambers.

6. A valve assembly as claimed in claim 5, in which a valve member is arranged to move into contact with a valve seat to close a fluid flow path and then move further to engage and move another valve to open another fluid flow path, said valve seat moving sealingly with the valve member during said further movement.

7. A valve assembly as claimed in claim 1, including a valve body comprising a body portion housing the valve members, and a cap portion housing said valve member receiving space for receiving an end of each valve member when the valve member moves, the interposer means comprising a plate-like member positioned between the body portion and the cap to prevent the end of at least one valve member from moving into said valve member receiving space.

8. A valve assembly as claimed in claim 7, in which said receiving space is comprised of a plurality of sockets, each for receiving an end of one of the valve members.

9. A valve assembly as claimed in claim 7, in which the interposer means comprises a plate rotatable about an axis, the plate having a plurality of apertures therein, spaced apart circumferentially around the axis.

10. A valve assembly as claimed in claim 9, in which the apertures are of different sizes.

11. A valve assembly as claimed in claim 9, in which the valve members and valve chambers are also spaced apart circumferentially around said axis.

12. A valve assembly as claimed in claim 11, in which the apertures are positioned with respect to the valve chambers and valve members such that in at least one position of the interposer means, only one valve member is movable to carry out a fluid flow control function, and in at least one other position of the interposer means, three valve members are movable simultaneously to carry out fluid flow control functions.

13. A valve assembly as claimed in claim 7, in which the valve body incorporates a relay valve for use in supplying fluid pressure simultaneously to all the valve members.

14. A valve assembly as claimed in claim 1, in which electrical means are provided for moving the interposer means.

15. A valve assembly as claimed in claim 14, in which manual means are also provided for moving the interposer means.

16. A valve assembly as claimed in claim 15, in which means are provided for locking the manual means when the electrical means is in operation.

* * * * *